US007066093B2

(12) United States Patent
Ronn et al.

(10) Patent No.: US 7,066,093 B2
(45) Date of Patent: Jun. 27, 2006

(54) MODULAR WARHEAD FOR UNITS OF AMMUNITION SUCH AS MISSILES

(75) Inventors: Torsten Ronn, Karlskoga (SE); Nils Johansson, Karlskoga (SE)

(73) Assignee: BAE Systems Bofors AB, Karlskoga (SE)

( * ) Notice: Subject to any disclaimer, the term of this patent is extended or adjusted under 35 U.S.C. 154(b) by 0 days.

(21) Appl. No.: 10/312,762

(22) PCT Filed: Jun. 6, 2001

(86) PCT No.: PCT/SE01/01404

§ 371 (c)(1),
(2), (4) Date: Jul. 14, 2003

(87) PCT Pub. No.: WO02/03017

PCT Pub. Date: Jan. 10, 2002

(65) Prior Publication Data

US 2004/0011238 A1 Jan. 22, 2004

(30) Foreign Application Priority Data

Jul. 3, 2000 (SE) ..... 0002484

(51) Int. Cl.
*F42B 12/58* (2006.01)

(52) U.S. Cl. ..... 102/489; 102/492

(58) Field of Classification Search ..... 102/473, 102/492, 489, 476, 478, 494, 483, 504, 506, 102/701

See application file for complete search history.

(56) References Cited

U.S. PATENT DOCUMENTS 2,358,899 A * 9/1944 Wilson ..... 102/473
3,646,888 A * 3/1972 Posson et al. ..... 102/496
3,818,833 A * 6/1974 Throner, Jr. ..... 102/389
3,960,085 A * 6/1976 Abernathy et al. ..... 102/492
4,289,073 A * 9/1981 Romer et al. ..... 102/476
4,754,706 A * 7/1988 Fauvel et al. ..... 102/489
H000699 H * 11/1989 Thomas, Sr. ..... 102/489
5,107,767 A * 4/1992 Schneider et al. ..... 102/489
5,544,589 A * 8/1996 Held ..... 102/492
5,605,308 A 2/1997 Quan et al.
6,619,210 B1 * 9/2003 Spivak et al. ..... 102/476
6,640,723 B1 * 11/2003 Spivak et al. ..... 102/483
6,672,220 B1 * 1/2004 Brooks et al. ..... 102/489
6,766,746 B1 * 7/2004 Spivak et al. ..... 102/489
6,834,593 B1 * 12/2004 Nardone et al. ..... 102/489

FOREIGN PATENT DOCUMENTS

DE 2519507 11/1976
DE 4025097 A1 2/1992
EP 0108741 A1 5/1984

* cited by examiner

*Primary Examiner*—Michael J. Carone
*Assistant Examiner*—John A Radi
(74) *Attorney, Agent, or Firm*—Connolly Bove Lodge & Hutz LLP; Larry J. Hume

(57) ABSTRACT

A warhead device comprising explosive charges and effect elements or effect agents for incorporation in a missile. The warhead device consists of a number of modules or modular charges (1*a*–1*f*) arranged to be actuatable between two or more pivotal positions in the cross-section of the warhead device. Each module comprises outer walls (9–14) that one by one are directed outwards depending on the position or pivotal position assumed by the module. Each outer wall of each module comprises warhead effect elements and/or effect agents that differ from the other warhead effect elements or agents. The outer walls that are directed outwards simultaneously form or are part of the common outer wall of the warhead device, and project a selectable warhead effect from the warhead device.

7 Claims, 7 Drawing Sheets

MODULAR WARHEAD FOR UNITS OF AMMUNITION SUCH AS MISSILES

Figure 1:
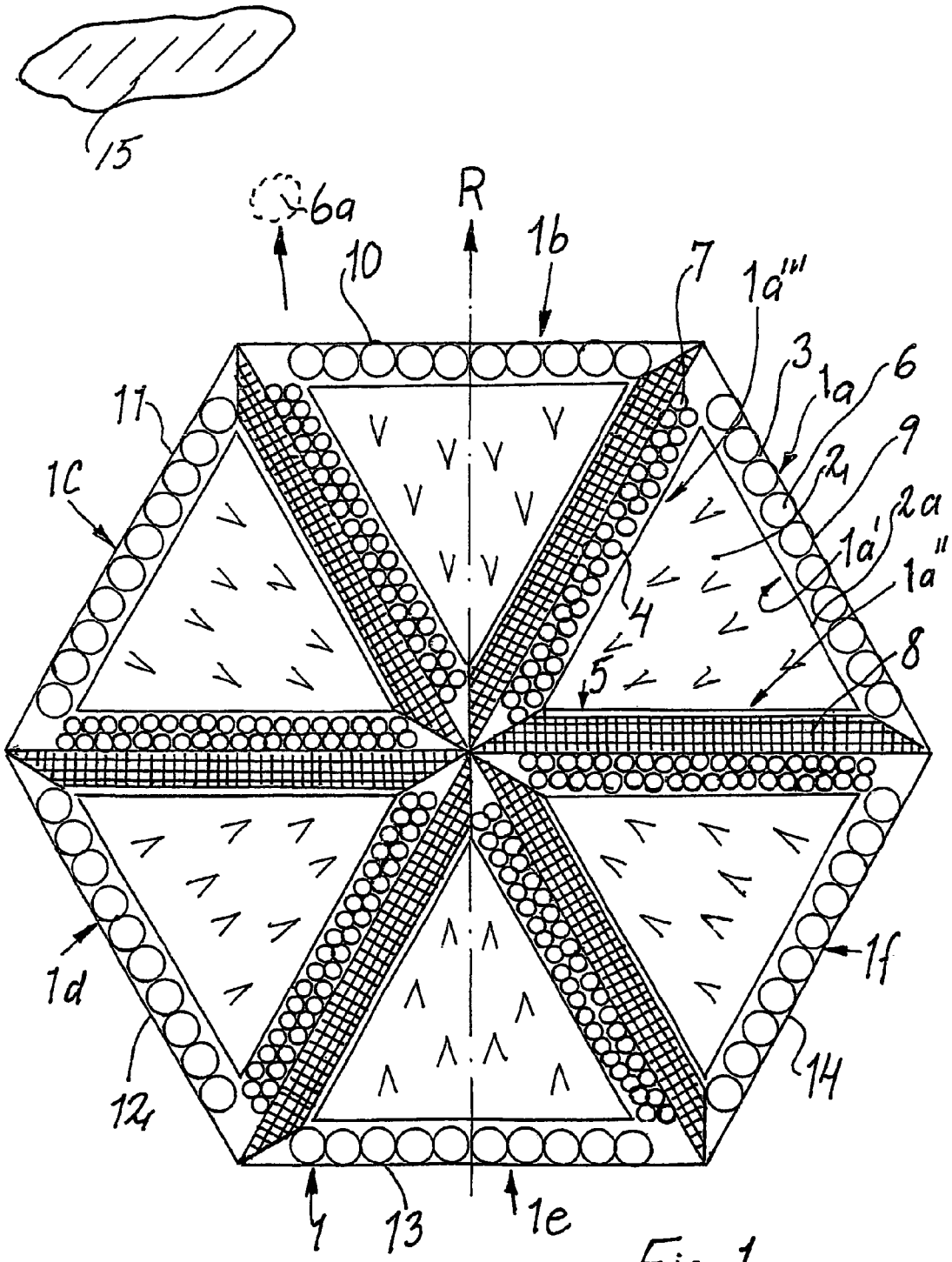

The present invention relates to a warhead device for ammunition units containing explosives and effect elements and/or effect agents. A missile is an example of a unit of ammunition, and examples of effect elements are small and large pellets, fragmentation, carbon fibre, etc. Effect agents refer to fragmentation inhibiting agents, blast generation agents, etc.

Ammunition units/missiles with different types of warheads that give different engagement results that can be used in different contexts are already known. General reference can be made to known warhead designs in patent literature.

There is a general desire to be able to reduce the assortment of different types of ammunition. A requirement of any such reduction is that the ammunition device shall retain its effectiveness, and meet the same requirements as previously regarding handling and service functions. The ammunition shall be able to function well in field conditions, and it shall still be possible to incorporate well proven components. It shall be possible to fabricate the warheads to occupy minimal space while enabling optimal effect in various contexts and engagement situations. The objective of the present invention is to resolve these problems completely or partially.

As claimed in the present invention it shall be possible to realise the above through the application of modular designs that enable re-configuration functions in the same ammunition unit/missile.

The main characteristics of the initially mentioned warhead device are, among other things, that it consists of a number of modules, and that the modules are arranged to be actuatable between two or more pivotal positions viewed through the cross-section of the warhead device. Other characteristic features are that each module comprises outer walls that one by one face outwards depending on the pivotal position assumed, and that the outer wall of each module comprises effect elements and/or effect agents that are different from the effect elements or effect agents of the other outer walls. Finally, the present invention is characterised by the fact that the outward facing outer walls of the modules constitute or are integral to the common outer wall of the warhead device.

In a preferred design variant the modules consist of six triangular elongated modular charges joined together to form a warhead device. Each triangular modular charge has three outer walls, each of which has a specific warhead effect layer. The space between the walls is filled with explosive, and the explosive in all the modular charges can be made to detonate simultaneously. The warhead effect layers can be arranged for large and small fragmentation effect and for incendiary effect. The modular charges or modules can be installed with the desired warhead effect layer facing outwards before the warhead is dispatched to the target. When the explosive detonates the warhead effect layers facing outwards provide the main effect of the warhead. This enables different forms of warhead effect to be selectable. In one design variant the arrangement can comprise large fragmentation elements with a large effect zone, small fragmentation elements with a small effect zone, or elements for incendiary effect. In another design variant the same warhead device can have different warhead effect layers facing outwards to project selective effects in different directions. The warhead effect layers that are thereby facing inwards in the warhead when it is actuated will also be dispersed, but with a considerably lower velocity and effect compared with the outwards facing layers.

In another preferred design variant the warhead device consists of seven cylindrical modular charges filled with explosive, and with the six outer modular charges arranged to be pivotable. Half the periphery of each modular charge can display a fragmentation layer while the other half is fabricated as thinly as possible with regard, in the first instance, to strength. In this case six additional increment charges, elongated and essentially triangular in cross-section, can be installed either inside or on the outside of the warhead. Each of the latter triangular increment charges thereby incorporates a metal liner to enable a shaped charge function. The warhead device is thereby arranged for fragmentation effect by pivoting or applying the modular charges so that the fragmentation layers and the metal liners face outwards, or for blast effect by pivoting or arranging the modular charges so that the fragmentation layers face inwards. In another design variant the modular charges or modules even in this case are arranged so that one or more have the fragmentation layer facing outwards and one or more have the fragmentation layer facing inwards, which means that fragmentation can be projected in the desired directions. Pivoting can be performed either manually before launch or automatically while the warhead device is travelling to the target. The six triangular increment charges are installed in the desired positions before launch. If the increment charges are installed externally they function like linear shaped charges, while if they are installed internally they contribute to the blast effect. In a preferred variant the modular charges or modules are arranged as elongated elements that can be interlocked with each other and/or to a relevant structural member of the ammunition device or missile. The said interlocking function can thereby be effected at the end(s) of each module. Each module can be equipped with an initiation device, fuze, etc that can be arranged to function jointly for all the modules or that can each be assigned a specific module. The pivotal positions of the various modules are thereby selectable depending on the type of target or target situation that the ammunition device is to engage. In an alternative design variant an initiation transfer arrangement can be arranged between the modules. Additional design versions of the present invention are disclosed in the subsequent Patent Claims.

The device described above resolves the above mentioned problems concerning engagement optimisation, efficient use of minimal space, reduced assortment of ammunition, etc. The shaped charge function mentioned enables substantial penetration during target engagement. The design of the various elongated modules enables relatively elementary handling as such. Already known snap-lock attachment or interlocking functions can be employed. The warhead device can be supplied in an initial mode with the modules located in a first pivotal position. If this initial pivotal position does not match the target engagement situation the interlocking functions of the modules can be released, and the modules can be actuated to other positions or pivotal positions in which the outwards facing effect layers of the modules or modular charges and their integral warhead effect elements and/or effect agents better match the current engagement situation. In an alternative design variant the missile/ammunition device and the modules can be supplied as individual units, after which on-site personnel can install the modules in the missile fuselage or structure or equivalent to achieve the desired optimised function.

Figure 2:
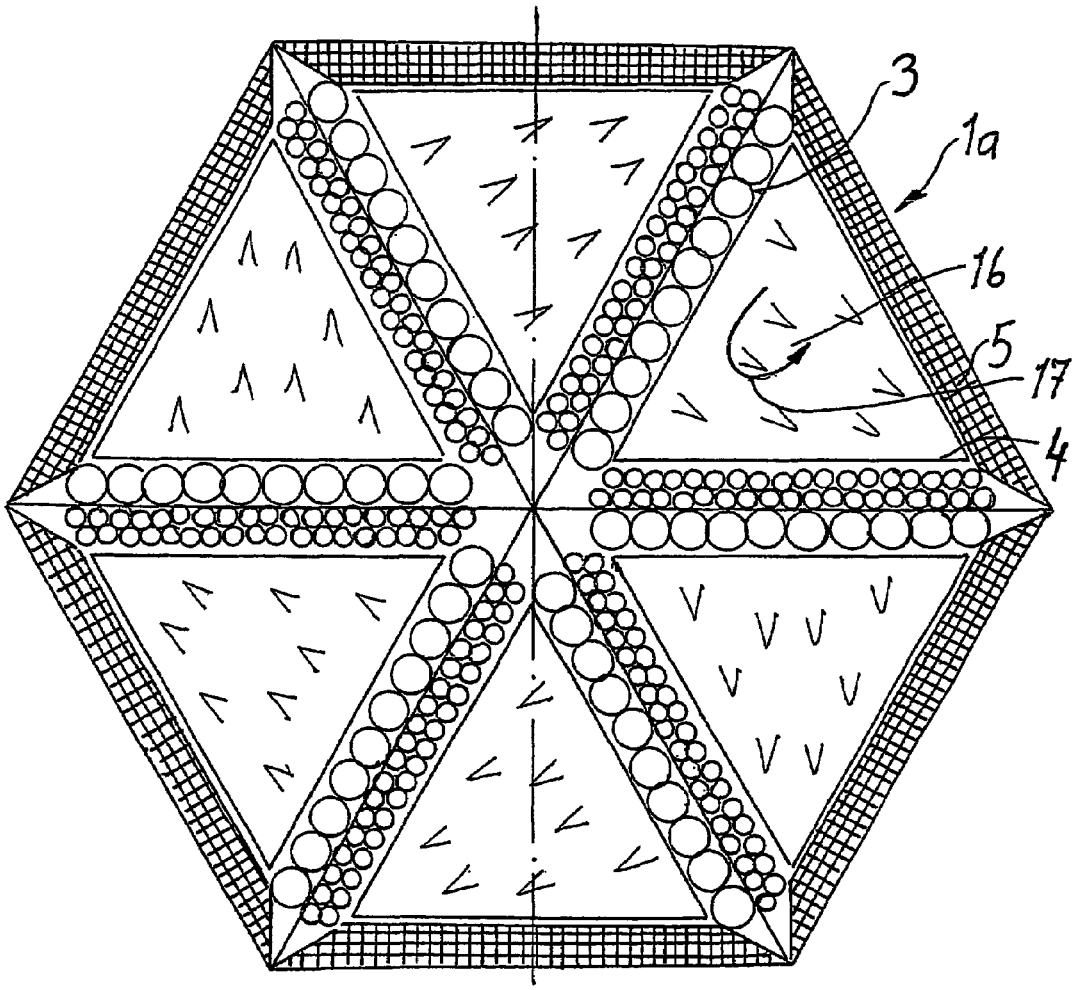
Figure 2A:
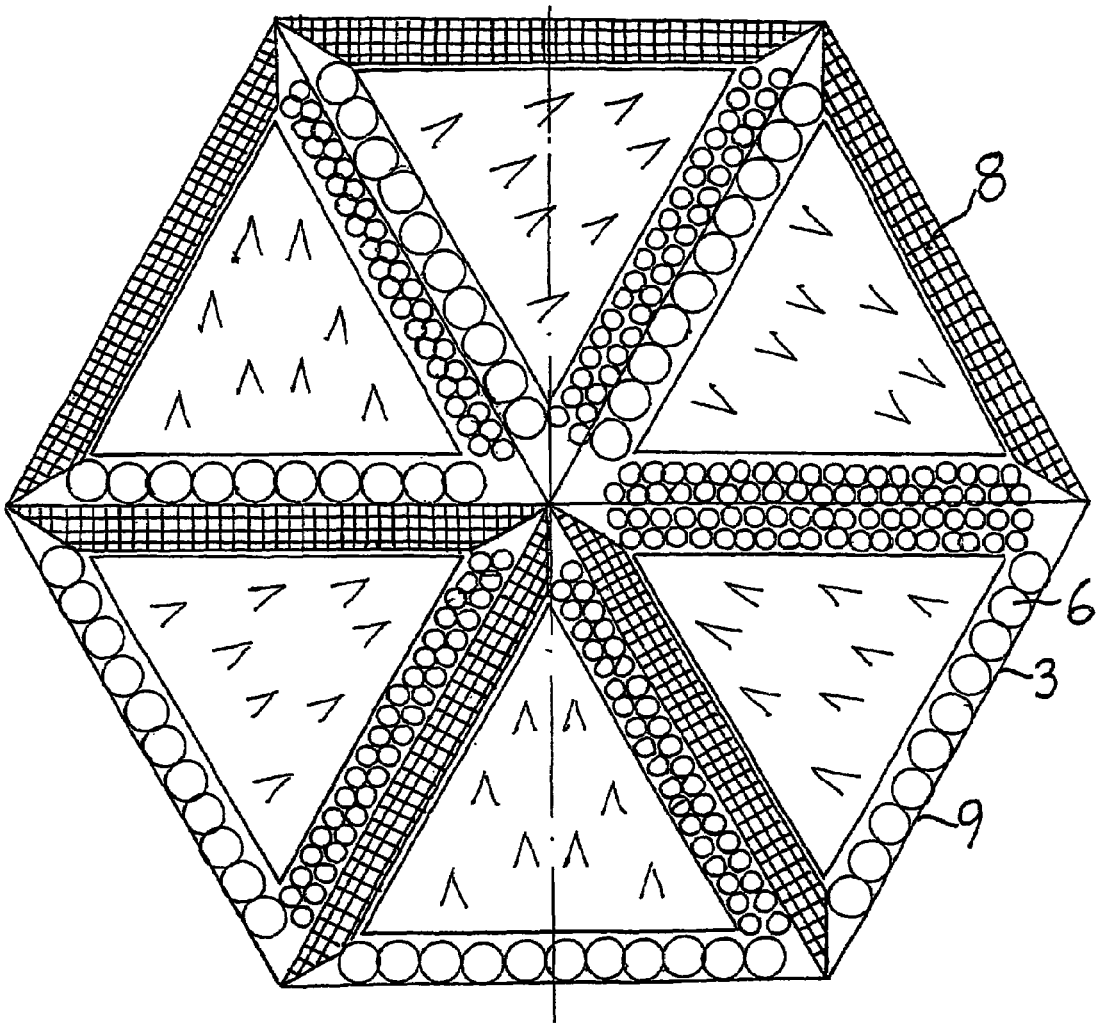
Figure 3:
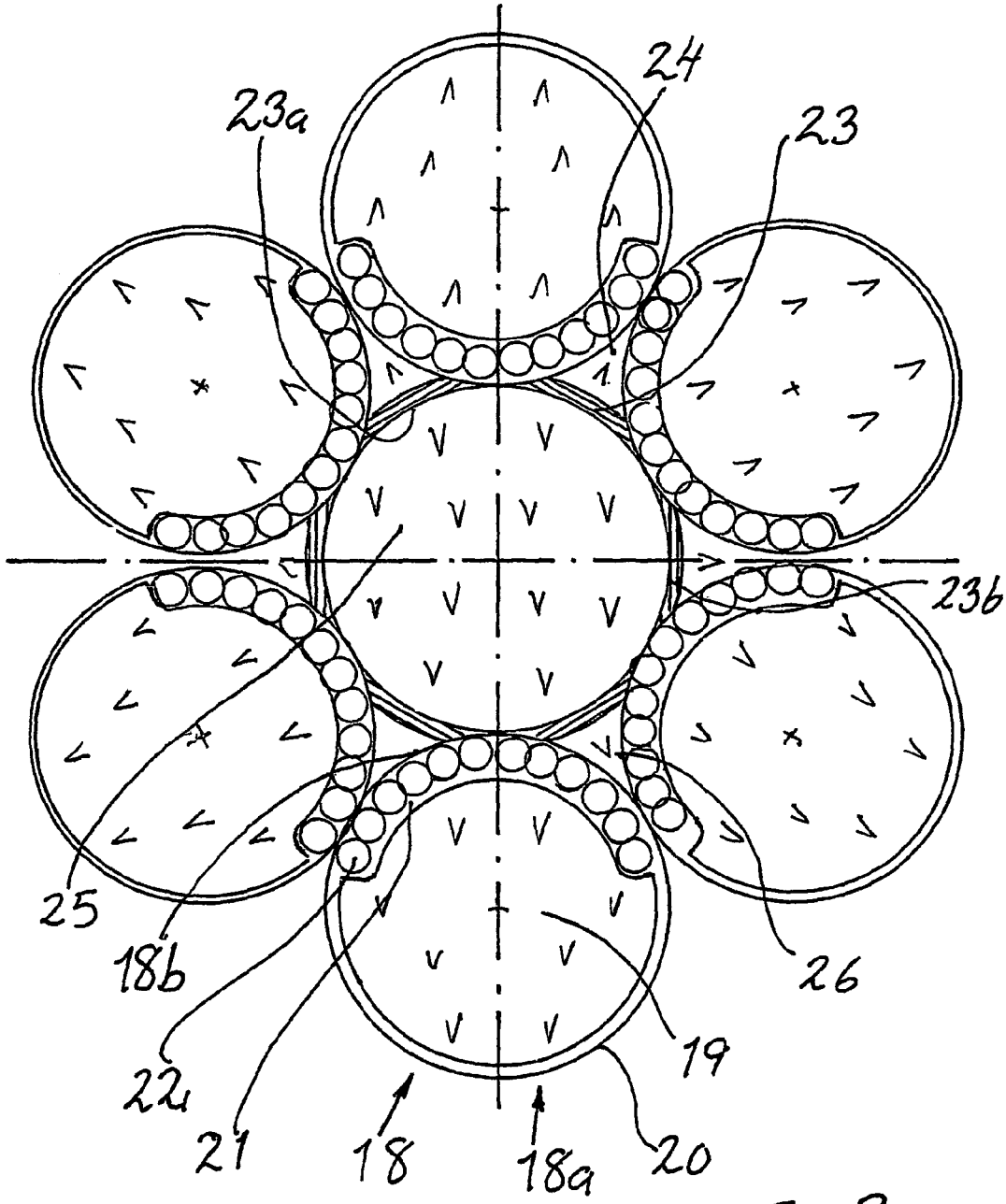
Figure 3A:
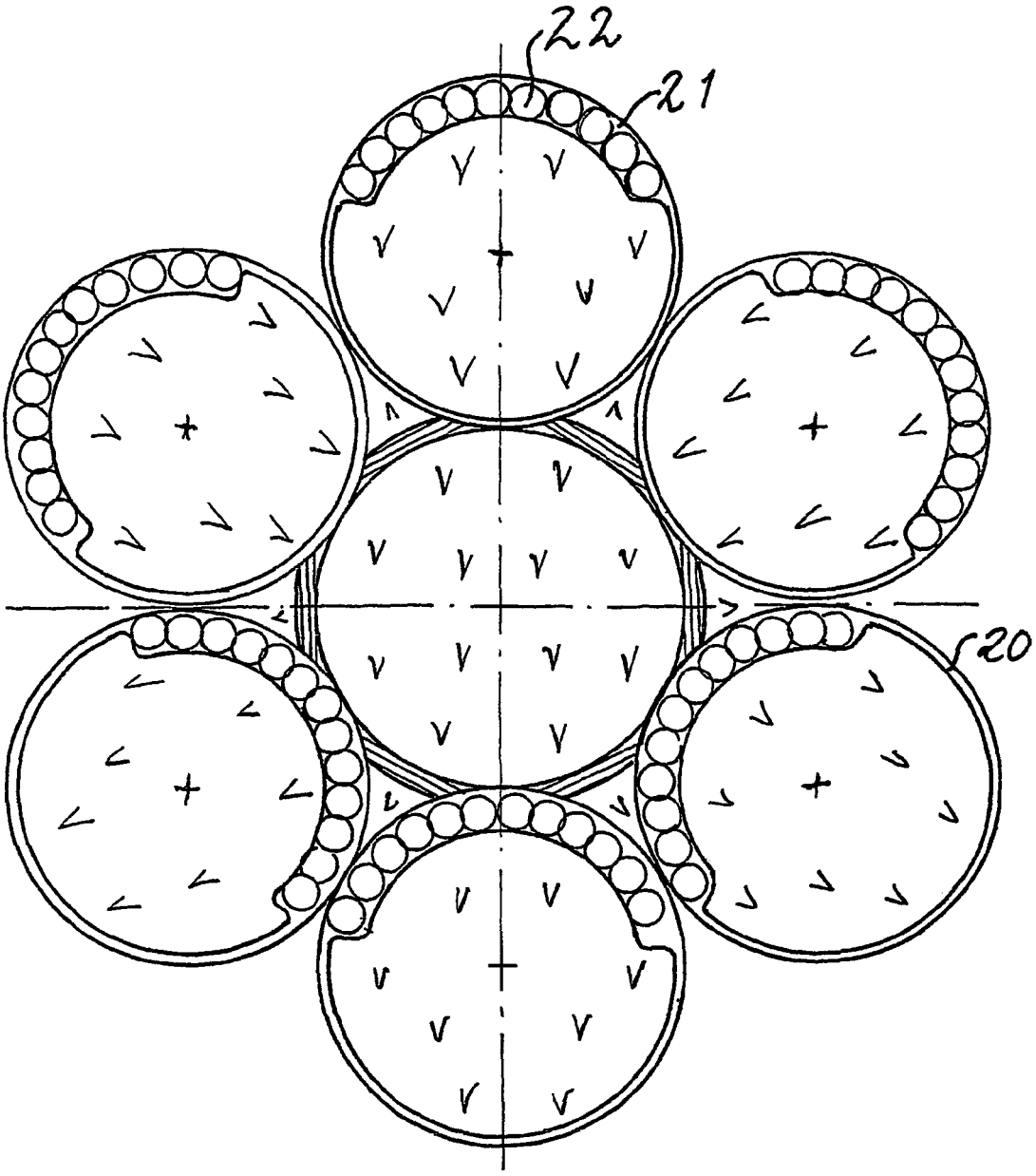
Figure 4:
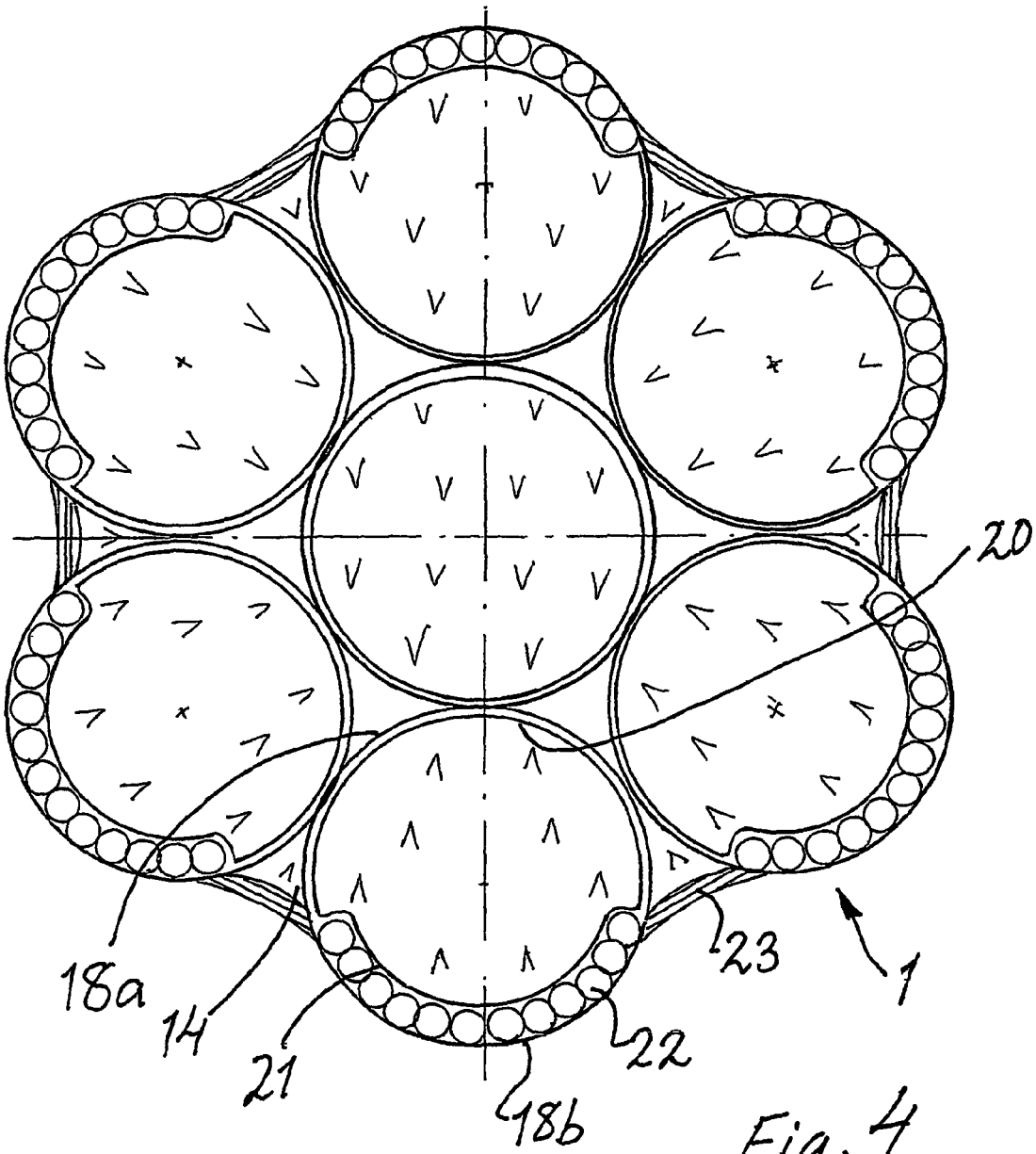
Figure 5:
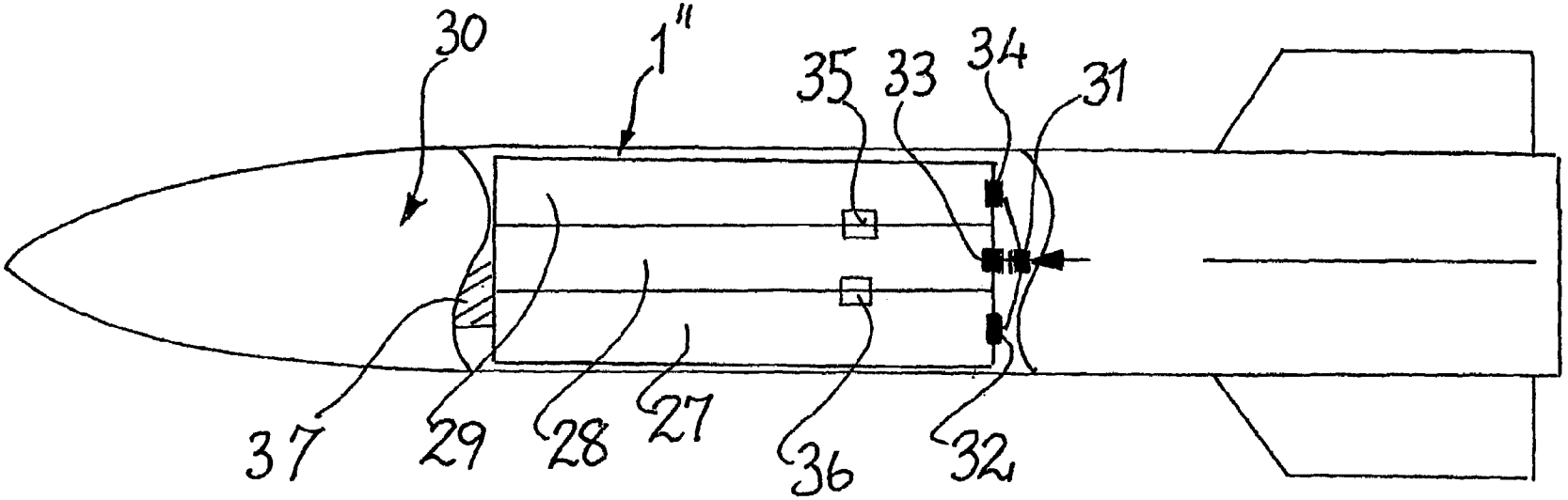

A currently proposed design for a device as claimed in the present invention is described below with reference to the appended FIGS. 1–5 in which FIG. 1 shows a cross-section of a first variant of a warhead device with modules or modular charges with a triangular cross-section, while FIG. 2 in a similar vertical section shows the warhead device illustrated in FIG. 1, but where the modules or modular charges incorporated in the warhead device are assigned pivotal positions that differ from the pivotal positions shown in FIG. 1, and FIG. 2*a* shows a vertical section in which the assigned positions of the modules have different types of warhead effect layers directed outwards, whereas FIG. 3 shows a vertical section of a second variant of the warhead device in which the modules or modular charges have the form of elongated cylindrical bars extending at right angles to the plane of the Figure, and where additional increment charges with metal liners integral to the shaped charge function assume internal positions in the warhead device, while FIG. 3*a* shows a vertical section of the variant illustrated in FIG. 3, but in this case various warhead effect layers are directed outwards for an actual actuation occasion, while FIG. 4 shows a vertical section of the variant illustrated in FIG. 3, but in this case the modules incorporated in the warhead device are assigned a different pivotal position at the same time that the increment charges with integral metal liners assume external positions on the warhead device, and FIG. 5 shows a longitudinal view of the design of the warhead device and its application in a symbolically designated missile together with a general overview of an initiation function.

FIG. 1 shows a warhead device designated 1. The warhead device in principle is comprised of six modules (or modular charges) 1*a*, 1*b*, 1*c*, 1*d*, 1*e* and 1*f*. Each module displays a triangular vertical section, and in the current example sides 1*a*′, 1*a*″ and 1*a*‴ are equally long so that in principle they form an equilateral triangle in the cross-section illustrated in FIG. 1. The elongated element extends at right angles to the plane of the figure in FIG. 1, and displays an essentially uniform shape along its entire length. As the various modules in the design example are essentially the same, only one module (or modular charge) will be described in detail. Module 1*a* incorporates an explosive charge 2 or explosive extending centrally throughout the length of the module. The explosive charge also has a triangular cross-section corresponding essentially to that of module 1*a*. On or outside the explosive charge, i.e. on or outside the outer surface of the charge—one of which outer surfaces is designated 2*a*, warhead effect layers 3, 4, 5 are arranged incorporating effect elements in the form of large pellets 6 and small pellets 7 and effect agent 8. The large pellets 6 are thereby arranged in warhead effect layer 3, the small pellets 7 in layer 4, and effect agent 8 in layer 5. In the present case the small pellets are arranged in two rows one above the other. The effect agent can consist, for example, of fragmentation inhibiting or blast generating agents. Warhead effect layers 3, 4 and 5 extend essentially along the length of the explosive charge 2 at right angles to the plane of the figure in FIG. 1. The pellets inlay and the effect agent inlay 8 extend in the same way along the entire length of the module 1*a*. In FIG. 1 the outer walls 9, 10, 11, 12, 13 and 14 of modules 1*a*–1*f* form the total common outer surface of the warhead device. As claimed in the present invention the various modules 1*a*–1*f* are pivotable to different pivotal positions, in each of which one of the walls of each module faces outwards. In the present example, wall 9 of module 1*a* is facing outwards with the result that warhead effect layer 3 with pellets 6 is positioned furthest out forming part of the common outer surface of warhead device 1. Other modules 1*b*–1*f* assume the same positions or pivotal positions, i.e. positions where the warhead effect layers with the large pellets are located in the common outer surface of the said warhead device. When initiating the explosive charges 2 of the said modules the rows of pellets of large diameter will be projected radially outwards. So, for example, the pellets of large diameter in module 1*b* are projected in the main direction R. A target 15 that is to be engaged using the effect elements in question win thus be hit by pellets 6*a* if the target is positioned in the direction concerned. In the present case it is thus assumed that the dimensions in question of the pellets are effective against the target 15 concerned.

In FIG. 2 each module (modular charge), such as module 1*a*, has been pivoted or actuated about its centre axis 16 that extends at right angles to the plane of the figure in FIG. 2. The pivoting or actuation in the present case has been performed counterclockwise, i.e. in the direction indicated by arrow 17. This means that the said warhead effect layers 3, 4 and 5 change position so that warhead effect layer 5 is facing outwards and is exposed for the target in question. Warhead effect layer 4 has in principle assumed the place of warhead effect layer 5, and layers 3 and 4 have similarly changed places. The effect agent (cf 8 in the above) in warhead effect jacket 5 is thereby directed at a target in question, against which the effect agent concerned is considered to be effective. A further pivoting or actuation about axis 16 in the direction of arrow 17 results in warhead effect layer 4 assuming the place previously occupied by layer 5, and so on.

FIG. 2*a* shows a design variant in which different warhead effect layers 3, 6 and 8 are directed outwards to project different warhead effects in different directions on an actuation occasion.

Instead of triangular modules the design variant illustrated in FIG. 3 uses cylindrical modules extending at right angles to the plane of the figure in FIG. 3. The cylindrical modules are in principle also designed in the same way, which is why only one module is described below. Even in this case there are six modules or modular charges. These modules, however, operate with different selectable pivotal positions, in which approximately half the circumference in each pivotal position is directed outwards. Each cylindrical module, such as module 18, comprises a central explosive charge 19 extending essentially along the length of the module. The pivotal outer segments of the module (modular charge) in each pivotal position in the present case are designated 18*a* and 18*b*, in which the module assumes a pivotal position where the outer segment 18*a* is exposed outwards. This outer segment of the module incorporates an effect layer 20 that can comprise an already known effect agent. 21 symbolises an effect layer for pellets of large dimension. In the present case additional increment charges with metal liners 23 and explosive 24 are arranged internally in the warhead device. Parts 23 and 24 comprise the function for shaped charge effect as described below. The increment charges 24 display an essentially triangular or prism-shaped cross-section with concave and essentially equally long sides adjoining the outer surfaces of the cylindrical modules and the outer surface of module 25. Increment charges 24 extend at right angles to the plane of the figure illustrated along the entire length of the warhead device. The modules 18 are pivotable relative to the increment charges 24. The metal liners 23 are curved and sub-surfaces 23*a* adjoin the outer surface of module 25. Increment charges 24 are extractable relative to the cylindrical modules 18 and the centrally arranged cylindrical module 25.

FIG. 3*a* shows the case in which different effect layers 20 and 21, 22 are facing outwards on one and the same actuation occasion, which means that the warhead device projects different warhead effects in different directions.

FIG. 4 shows the case when the said second pivotal position has been assumed, and effect layers 20 and 21 have in principle changed places. The pellets 22 are thereby positioned at the common outer surface of the warhead device 1', of which outer segment 18*b* constitutes an integral part. The latter outer segment has changed places with outer segment 18*a*. In this case the increment charges 23 and 24 have changed location from their inner positions illustrated in FIGS. 3 and 3*a* to outer positions where the metal liners 23 can be considered to connect the outer segments 18*b*. In these outer positions the increment charges produce shaped charge effect. This arrangement enables outstanding penetration force by virtue of the shaped charge function. Effect layer 20 is thin and its thickness satisfies in the main the strength requirement in each module (cf 18 in FIG. 3).

In FIG. 5 the modules in warhead device 1" are designated 27, 28, 29. The warhead device is arranged inside an ammunition unit or missile 30, inside which there is arranged an already known initiating device incorporating fuzing devices 31, 32, 33 and 34. The detonating functions can be individual for the various modules 27, 28, 29, or alternatively a common initiating function can be used with boosters 35, 36 of already known type arranged between modules 27, 28, 29 in each other's opposing walls. The interlocking (snap-lock) device in which the modules are pivotable or interlockable is designated 37.

As claimed in the design example illustrated in FIGS. 1–2*a* above the various modules are assigned their respective pivotal positions by first extracting the modules axially or by lifting them out radially from their positions in question, assigning their new pivotal positions outside the arrangement, and thereafter re-installing them in the ammunition unit or warhead device in their new positions. Such a programming or switching is performed on the ground. With reference to FIGS. 3–4 it is understood that each of the increment charges with a triangular or prismatic cross-section consists of a metal liner and explosive joined together. It is intended that re-configuring of the increment charges be performed on the ground. The cylindrical modules, which are in principle pivotable, can be assigned their pivotal positions either on the ground or while airborne. The triangular increment charges with integral metal liners can produce an effective shaped charge effect. In one application of the warhead device described above the triangular increment charges can be positioned inside the warhead device while the pellets effect layer is directed inwards. This results in a blast effect with simultaneous insignificant fragmentation effect. No shaped charge effect occurs in this case. If, on the other hand, the warhead is arranged with the triangular increment charges positioned with the curved metal liners directed outwards, the said shaped charge effect is produced. In this case, if the modules are positioned with their respective layers of pellets directed outwards the result is shaped charge effect in combination with fragmentation effect. It is considered that different positions can be used for the various modules or modular charges, and that one can obtain different effects in different sectors such as fragmentation in one sector and no fragmentation in another sector, etc. It is also considered that there is a wide choice of options regarding the design of the various warhead effect layers so that, for example, a double layer of small pellets could be used. In the first design example above each triangular module has three outer walls, each of which has a specific warhead effect layer. The space between the walls is filled with explosive, and the explosive in all the modules can be made to detonate simultaneously. In the design example shown in FIGS. 3–4 the warhead device comprises seven cylindrical modules filled with explosive, of which the six outer modules are rotatable while the centrally arranged module is non-rotatable. Rotation can be performed either manually before launch or automatically while the warhead device is travelling to the target. The six triangular increment charges can be installed in the desired positions, and the modules can thereby be arranged for maximum fragmentation effect combined with shaped charge effect from the increment charges. In the alternative mode the modules can be arranged for minimal fragmentation effect by arranging the triangular increment charges internally in the warhead device.

The present invention is not limited to the design examples illustrated above, but can be subjected to modifications within the framework of the subsequent Patent Claims and the invention concept.

We hereby claim and desire to secure by Letters Patent the following:

1. An ammunition unit, comprising:

a plurality of modules, each module comprising:

a plurality of discrete warhead effect layers arrange sequentially around the outer surface of the module and an explosive charge, wherein the modules are individually pivotable within the missile body.

2. The ammunition unit of claim 1, wherein each module is actuatable between two or more positions.

3. The ammunition unit of claim 2, wherein each module comprises three warhead effect layers.

4. The ammunition unit of claim 2, wherein the warhead modules are substantially cylindrical and are pivotable about longitudinal axes.

5. The ammunition unit of claim 4, comprising:

an explosive module disposed within the plurality of modules.

6. The ammunition unit of claim 2, wherein the warhead units are substantially triangular in cross section and are pivotable about longitudinal axes.

7. The ammunition unit of claim 1, comprising:

at least one fusing device disposed to actuate the explosive charges of the modules.

* * * * *